US006161506A

United States Patent [19]

Hanson

[11] Patent Number: 6,161,506

[45] Date of Patent: Dec. 19, 2000

[54] PULSED AIR COMBUSTION HIGH CAPACITY BOILER

[75] Inventor: Garry O. Hanson, Florence, Ky.

[73] Assignee: Harsco Corporation, Patterson-Kelley Division, Fairmont, Minn.

[21] Appl. No.: 09/396,152

[22] Filed: Sep. 15, 1999

[51] Int. Cl.[7] ..... F22B 5/02

[52] U.S. Cl. ..... 122/18.3; 122/18.31; 122/24; 122/135.1; 122/367.1; 431/1

[58] Field of Search ..... 122/24, 135.1, 122/137, 153, 158, 166.1, 169, 183, 185, 367.1, 18.3, 18.31; 431/1

[56] References Cited

U.S. PATENT DOCUMENTS

| | | | |
|---|---|---|---|
| 2,911,957 | 11/1959 | Kumm | 122/16 |
| 3,223,136 | 12/1965 | Mutchler | 158/11 |
| 4,241,723 | 12/1980 | Kitchen | 126/350 R |
| 4,368,677 | 1/1983 | Kline | 110/212 |
| 4,639,208 | 1/1987 | Inui et al. | 431/1 |
| 4,640,674 | 2/1987 | Kitchen | 431/1 |
| 4,846,149 | 7/1989 | Chato | 126/360 |
| 4,926,798 | 5/1990 | Kardos | 122/24 |
| 4,960,078 | 10/1990 | Yokoyama et al. | 122/24 |
| 4,995,376 | 2/1991 | Hanson | 126/110 |
| 5,044,928 | 9/1991 | Yokoyama et al. | 431/1 |
| 5,137,056 | 8/1992 | Christopher et al. | 137/854 |
| 5,145,354 | 9/1992 | Palm, Jr. | 431/1 |
| 5,211,704 | 5/1993 | Mansour | 431/1 |
| 5,242,294 | 9/1993 | Chato | 431/1 |

*Primary Examiner*—Denise L. Ferensic
*Assistant Examiner*—Jiping Lu
*Attorney, Agent, or Firm*—Duane, Morris & Heckscher LLP

[57] ABSTRACT

A pulsed combustion high capacity boiler has air inlet flapper valves at an inlet air decoupler toward a combustion chamber, with a fuel supply and an ignitor upstream of the combustion chamber along a flow path. The combustion chamber is immersed in a water jacket, and downstream of the combustion chamber a plurality of exhaust pipes are immersed in the water jacket and lead to an exhaust decoupler. The exhaust decoupler is disposed outside of the water at the periphery of the unit. An orifice assembly along the flow path defines a flow restriction producing turbulence and preferably serially combines a reduction in cross sectional area followed by a diverter having vanes to induce further turbulence. The ignitor and fuel supply are enabled by a controller that senses spark and combustion flame, and also enables a blower at least during a startup interval. The air inlet flapper admits air, opening and closing at a resonant frequency during combustion. At least the combustion chamber and the exhaust pipes are substantially enclosed in the water jacket and together define a water tank that can be part of a circulating water system. Inasmuch as the exhaust decoupler is mounted on the outer perimeter, preferably at the bell end of the boiler outside of the water jacket, the outermost wall at that end can be made of light sheet metal rather than heavy pressure-resistant plate. Due to the structure, the bell end need only withstand the pressure differential between the gaseous exhaust and ambient pressure.

17 Claims, 8 Drawing Sheets

PULSED AIR COMBUSTION HIGH CAPACITY BOILER

BACKGROUND OF THE INVENTION

1. Field of the Invention

The invention relates to the field of pulsed combustion devices, and in particular concerns an optimized oil-fired boiler driven by pulse-controlled convection, having a gas/fluid heat exchanger for extracting heat energy from hot exhaust gases.

According to the invention, flapper valves on an air inlet decoupler chamber oscillate the feed air flow. A fuel nozzle injects atomized fuel. Structures located downstream of the air and fuel inlets along the air flow path cooperate by successively diverting flow in different directions to induce turbulence, for example inducing toroidal and then helical flow and corresponding additive eddy currents for good air/fuel mixing. Oscillation is maintained due to the push-pull effect on pressure conditions of alternating expansion and exhaust of the combusting air/fuel mixture, which pressure conditions drive the closing and opening of the flapper valves and contribute to the flow of combustion gases in the draft direction toward the exhaust. The hot exhaust gases pass from the combustion chamber through a heat exchanger tube bundle that is immersed in a water jacket defined between the concentric walls of the combustion chamber and an outer housing of the unit. The tube bundle comprises an array of axially and radially elongated U-shaped tubes in the annular space between the combustion chamber and the outer walls. Each tube is coupled between an inner annular tube manifold plate on the upstream side of the flow path and an outer annular tube manifold plate on the downstream side, with the connections of each tube to the inner and outer manifold plates being angularly advanced such that the array is compactly compressed. The downstream or outer annular tube manifold opens into an exhaust decoupler chamber that is bounded by the outer bell end of the generally cylindrical unit such that the axial end of the housing encloses the gas flow path rather than the water jacket.

2. Related Art

Pulsed combustion devices generally comprise a combustion chamber and one or more exhaust pipes arranged to transfer heat into a forced air heating system or into the water of a boiler. Pulse combustion can involve pulsing the fuel and/or air that is fed to the combustion chamber. A pulse air system can have an inlet air valve leading to the combustion chamber, arranged to resonate at an oscillation frequency determined by the combustion chamber volume, the volume of the exhaust pipes, the length of the exhaust pipes, and other physical parameters (such as the speed of sound).

A pulsed air combustion device can be considered to operate on an oscillatory pressure cycle. In general, the air/fuel charge ignited in the combustion chamber expands as it is heated, and flows into and through the exhaust pipes due to expansion with combustion and heating. Combustion expansion causes a local pressure increase at the area of combustion. There are obstructions placed upstream of the combustion area or chamber, namely closer to the air inlet compared to the draft or flow direction (including at least the inlet flapper valves). The expansion thus moves the gases forward in the draft direction in a higher pressure phase of the combustion cycle. In addition, convective flow of hot gases in the draft direction creates a partial vacuum at the combustion chamber in a lower pressure or relative vacuum phase of the pressure cycle, which assists in drawing a fresh air/fuel charge into the combustion chamber. With correct timing, including oscillation of the air inlet at the required frequency, pulsed combustion ensues and becomes self sustaining. The fresh air/fuel charge can be spontaneously ignited when exposed to still-combusting gases or to the latent heat of the combustion chamber. An initial cycle is established through ignition by a spark, pilot flame or glow plug, and the process is then self sustaining, with an oscillatory pressure fluctuation superimposed on a general flow of gases from the inlet to the outlet.

With appropriate adjustments to the dimensions of the respective chambers and the valves or other means that control the feeding of air and fuel, it is possible to vary parameters including the resonant frequency of the device, the rate of fuel combustion, the ratio of air feed to fuel volume and the like. One objective of such adjustments is to extract as much thermal energy as possible from the fuel used, by complete combustion and efficient thermal energy transfer. There may be other objectives in addition to efficiency, such as maintaining a high rate of thermal energy transfer. Other objectives such as durability versus expense and ease of construction, are also involved. These objectives compete and may involve opposite considerations, such that they are difficult to optimize together.

Pulse combustion technology is advantageous for meeting many of the objectives, especially in water heating units intended for high rates of thermal energy transfer. Pulse boilers also have unique design concerns. For example, such units operate resonantly at low frequency and generate acoustic noise.

Combustion boilers are advantageously compact. It is particularly important to make the device compact if the heat transfer fluid (water) is to be pressurized. If the pressure confined in a vessel is increased, it is obviously necessary to make the walls of that vessel thicker to withstand the additional pressure. Moreover, at a given pressure, if the span of a pressure confining wall of a vessel is increased, that is if a wall is widened and/or lengthened to encompass a greater area, it is also necessary to make that wall thicker. However, the relationship of required wall thickness versus wall span in a pressure vessel is a geometric relationship. Thus it is particularly important to keep the design compact.

With thermal transfer between combustion gas and a pressurized fluid, a relatively small heat transfer surface provides good efficiency of heat transfer on the fluid side. A water jacket can substantially or only partly enclose a combustion chamber and its associated exhaust gas conduits. Heat transfer fins and surfaces can be employed to increase the rate of thermal transfer by increasing the surface contact area, particularly on the exhaust or flue gas side of the heat exchange surfaces.

The extent of thermal transfer normally can be increased by more completely and deeply embedding the combustion and exhaust portions of such a unit in the water jacket. For example, the combustion chamber can be placed well within a large water jacket volume that encloses the combustion chamber on all sides. The exhaust pipes can be arranged to carry the hot exhaust gases a long distance through the water jacket by which heat is extracted, and the water or other coolant can be kept at a relatively low temperature such that the ultimate exhaust to the ambient atmosphere is relatively cool compared to the combustion temperature. However, these aspects add to the overall size and complexity of the unit. Lengthening the exhaust pipes also lowers the resonant frequency of the system. Such changes may increase thermal energy transfer efficiency but can have other drawbacks and advantageously should be optimized.

A pulse combustion furnace for liquid or gaseous fuel is disclosed in U.S. Pat. No. 4,995,376—Hanson. This patent discloses and claims certain structural details that preferably are applied to the boiler of the present invention. The '376 Hanson patent is hereby incorporated by reference for its disclosure of structures in common with the preferred embodiments of the present invention.

U.S. Pat. No. 5,242,294—Chato discloses a pulse combustion boiler which operates at a high resonant frequency (i.e., 440 Hz). U.S. Pat. No. 4,951,706—Kardos discloses a flapper air check valve for oscillating the feed air to a combustion device. The disclosures of these references are also hereby incorporated.

There is a need for a high-capacity pulse combustion boiler, having a compact design and an acceptable acoustic noise level, which is optimized for efficiency in its rate of heat transfer, and is also characterized by design features that contribute to efficiency while maintaining a compact size. Preferably, this should be accomplished without contributing unduly to the cost and complexity of the device and with minimum requirements for unduly heavy or complex construction.

SUMMARY OF THE INVENTION

It is an object of the invention to provide a high-capacity, oil-fired boiler having a compact design, limited noise emissions and an optimally lightweight yet durable construction.

It is another object of the invention to provide a pulse combustor having two or more inlet air flapper valves associated with a pressure decoupling inlet plenum.

It is an object to extract added efficiency from an air-pulsed boiler by providing a series of sequential turbulence inducing structures along the gas flow path adjacent to and downstream of the fuel feed, each of the structures contributing a distinctly oriented form of turbulence.

It is a further object to facilitate use of the boiler as described, with pressurized water or other heat transfer fluid, by placing the exhaust gas outlet decoupler or manifold at an external surface of a generally cylindrical water jacketed structure, thereby reducing the size of structures needed to enclose the pressurized water volume and thus substantially reducing the weight of material needed.

It is another object of the invention to meet the foregoing objects in an oil fired pulse combustor wherein an oil pressure pump supplies a continuous supply of atomized oil to the system and combustion is pulsed by a pressure/vacuum driven air inlet valve structure, and furthermore to control initiation of operation by sensing combustion and coordinating operation of a startup blower, spark ignition device and fuel pump.

These and other objects are accomplished by the pulse combustor disclosed herein. The unit can be generally tubular externally, and the flow of combustion air, mixed fuel and air, combusting fuel and air, and then exhaust, can proceed through a thermally conductive conduit disposed substantially along a longitudinal centerline of the combustor and leading into an array of thermally conductive conduits for the hot exhaust gases. These structures heated by combustion are immersed within a housing forming a water jacket. The combustor is fed with pulsed air from an inlet decoupler having flapper check valves arranged to oscillate the feed of combustion air. The combustion air is led to a point at which atomized fuel is inserted, namely fed by a pump. An igniting device is provided for initiating combustion. The combustion heats the structures along the path through the area of combustion. After initiation, latent heat of the structures at and adjacent to the combustion chamber, and the presence of still-combusting fuel are such that the combustion becomes self sustaining. Such structures preferably include, for example, a protruding steel bar that extends into the combustion chamber, as in the '376 Hanson patent mentioned above.

According to an inventive aspect, fuel and combustion air are fed toward the area of active combustion from a point upstream of an inlet orifice assembly along the gas flow path. The inlet orifice assembly defines an opening that has a smaller cross sectional area than that of the combustion chamber downstream of the inlet orifice assembly, and preferably also smaller than the dimensions of the conduit leading up to the inlet orifice assembly. The respective flow paths, chambers and openings can advantageously be circular/cylindrical. The reduced area inlet opening in the inlet orifice assembly provides a flow restriction that tends to induce an annularly rolling or toroidal form of turbulence. The restriction also increases the linear speed of the flow of mixed air and fuel in the area of the restriction as compared to points upstream and downstream of the restriction. The restriction can be irregular or shaped to provide smooth flow and minimum air pressure loss, and may involve a venturi effect. Downstream of the restriction is a preferably-louvered diverter having radially extending vanes that are canted in a circumferential direction and thus induce a helical component to the flow. By adding at least these successive distinct turbulence effects, namely an annular rolling turbulence downstream of the restriction and a helical turbulence downstream of the vanes, and optionally additional turbulence inducing structures encountered along the flow path, the fuel and combustion air are thoroughly mixed when the flow reaches the combustion chamber, for relatively complete and efficient combustion.

In addition to the foregoing cross sectional restriction(s) associated with the inlet orifice, the combustor preferably further comprises a cross sectional restriction that is spaced downstream along the flow path from the inlet orifice, substantially comparable to the flame tube plate of the '376 Hanson patent. The area between the inlet orifice and the flame tube plate defines a mixing chamber upstream of the greater part of the zone of combustion, at which mixing chamber the combustion air and atomized fuel are turbulently mixed. The respective cross sectional restrictions, including the turbulence inducing structures at the inlet orifice and at the flame tube plate at the downstream end of the mixing chamber, are effective in providing a certain back pressure during the pressure phase of combustion to urge the expanding gases forward toward the exhaust.

During ongoing operation (i.e., after a startup period), the structures along the flow path can become heated by the combusting fuel to a temperature above the ignition temperature of the air/fuel mixture, particularly structures that protrude into the flow path. These heated structures can provide a source of ignition after startup, while inducing further turbulence. Alternatively or in addition, still-combusting fuel that is encountered by mixed incoming air/fuel mixture can provide the means to ignite the incoming fuel after startup. In the preferred arrangement, at least one structure is disposed across the primary flow path of combusting gases, such as the protruding inconel steel bar of the '376 Hanson patent, which is heated during ongoing operation at least to the combustion temperature of the air/fuel mixture.

Downstream of the combustion chamber, hot exhaust gases flow into an array of heat exchange tubes coupled to a circular chamber disposed axially adjacent to the combustion chamber. A first annular distribution plate directs the exhaust gases into an array of heat exchange tubes that extend axially back, parallel to and at a radial space from the combustion chamber. The heat exchange tubes curve radially outwardly and extend axially forward, again parallel to the combustion chamber, to a second annular distribution plate that is axially spaced from and radially outside the first annular distribution plate. Thus at least two levels of passing conduits, and optionally more levels, carry the heated exhaust gases and provide a heated surface for extraction of thermal energy.

The heat exchange tubes and the combustion chamber are enclosed in an outer wall structure defining a water jacket in which the combustion chamber and the heat exchange tubes are immersed. The first annular distribution plate and the circular chamber bounded thereby are likewise immersed in the water jacket. The second annular distribution plate is disposed on the outside of the water jacket, and defines with an outer bell end of the device an exhaust decoupler chamber that is coupled to an exhaust conduit for ultimately venting the exhaust gas.

Fuel such as fuel oil or the like is discharged into the flow upstream of the combustion chamber. Preferably the fuel is pumped, or otherwise is caused to provide a substantially continuous fuel supply during operation. The fuel nozzle can discharge from a point along a center line of the flow, axially positioned substantially flush with the inlet orifice or flow restriction. In a preferred embodiment, the fuel nozzle comprises a coaxially arranged fuel conduit along the center line, protected from substantial heating by a surrounding sleeve. The sleeve can be provided with openings that permit air flow between the fuel conduit part of the nozzle and the sleeve, for additional cooling effect.

The air intake assembly supplies pulsed combustion air, for example from ambient air. The air intake assembly provides a means for restricting the rate at which combustion air is fed, and also functions as a pressure decoupling input plenum. The air intake assembly comprises an air decoupler chamber containing at least one and preferably a pair of bell-shaped housings, each having a check valve permitting only incoming flow. The check valve is in the form of an air flapper valve assembly that oscillates with resonant operation of the combustor.

Inasmuch as the structures confining the area of combustion and the adjacent downstream exhaust are collectively enclosed in the water jacket, which forms a cylindrical water tank surrounding the heated structures, heat energy is collected efficiently in the water in the tank. The water jacket encloses the combustion gases up to the exhaust decoupler at the bell housing at which the combustor is coupled to the second or outer annular distribution plate and to the ultimate exhaust conduit. The exhaust decoupler at the bell housing is maintained slightly above atmospheric pressure, but can be at a substantially lower pressure than the water tank, which is optionally pressurized and is coupled into an external system that usefully employs the heat energy. Assuming that the water jacket contents are pressurized, the outer bell housing can comprise a relatively light sheet metal material because it confines the exhaust gas flow instead of a thick pressure resistant wall as would be needed to bound a pressurized water tank. The structure confining the water tank, namely the first or inner annular distribution plate, is sufficiently heavy to confine water tank pressure, but is correspondingly smaller in area than the outer bell housing. This arrangement renders the combustor both compact and relatively light in weight compared to the heat energy that it can generate.

The turbulence inducing flow structures of the combustor and the physical confinement or encirclement of the combustion area and at least the upstream portion of the exhaust conduit(s) in the water jacket, provide for efficient thermal transfer to the water jacket of heat generated by the fuel during pulsating combustion. The water jacket preferably is coupled into a circulating water or steam system that makes use of the heat, such as a building heating system, an industrial process heat exchanger or another such application. This efficiency is achieved in a combustor that is lightweight, inexpensive and quite durable as compared to the heat capacity and efficiency at which it operates.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1A:
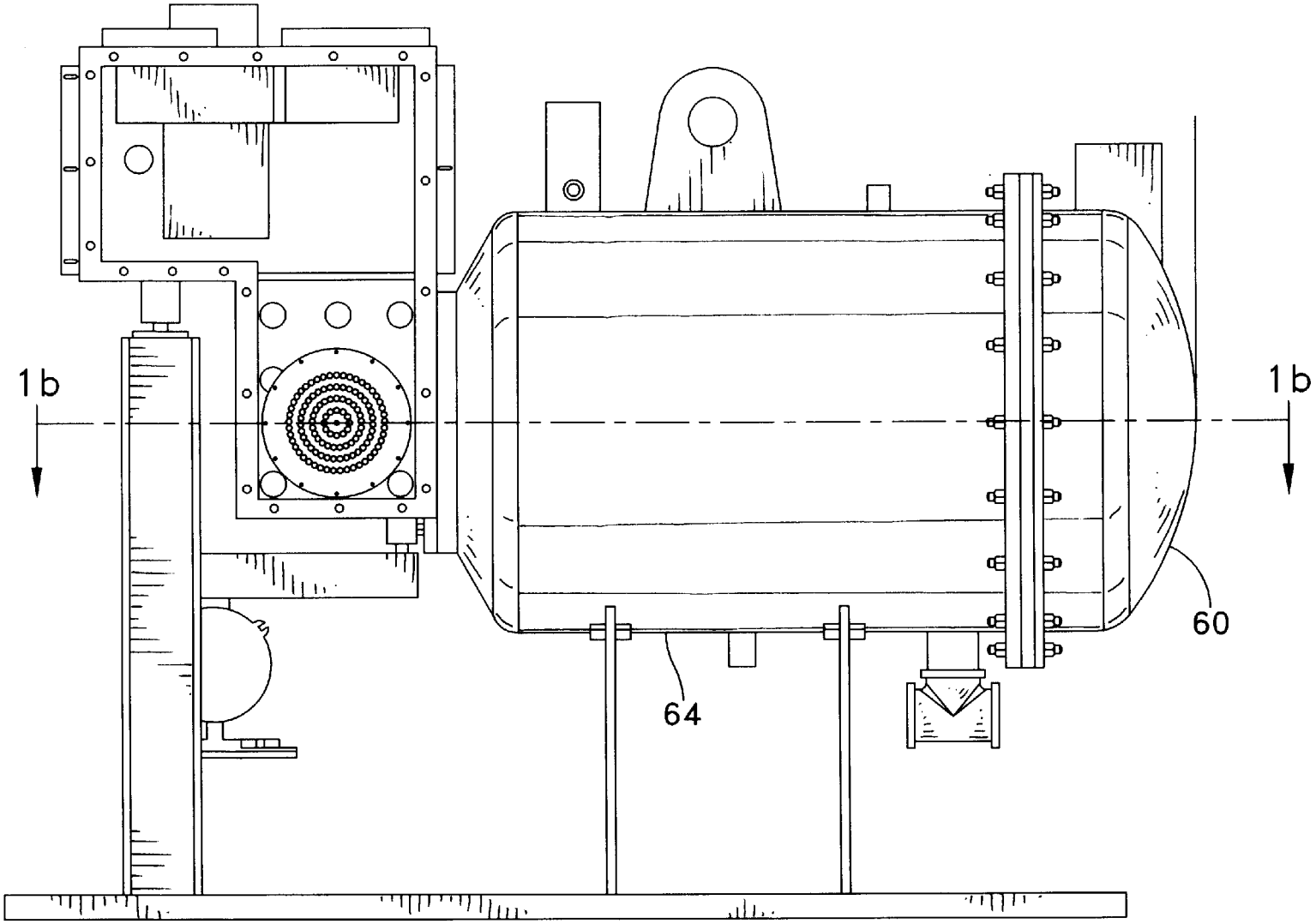
FIG. 1*a* is a side elevation of a pulse-combustion boiler according to the invention.
Figure 1B:
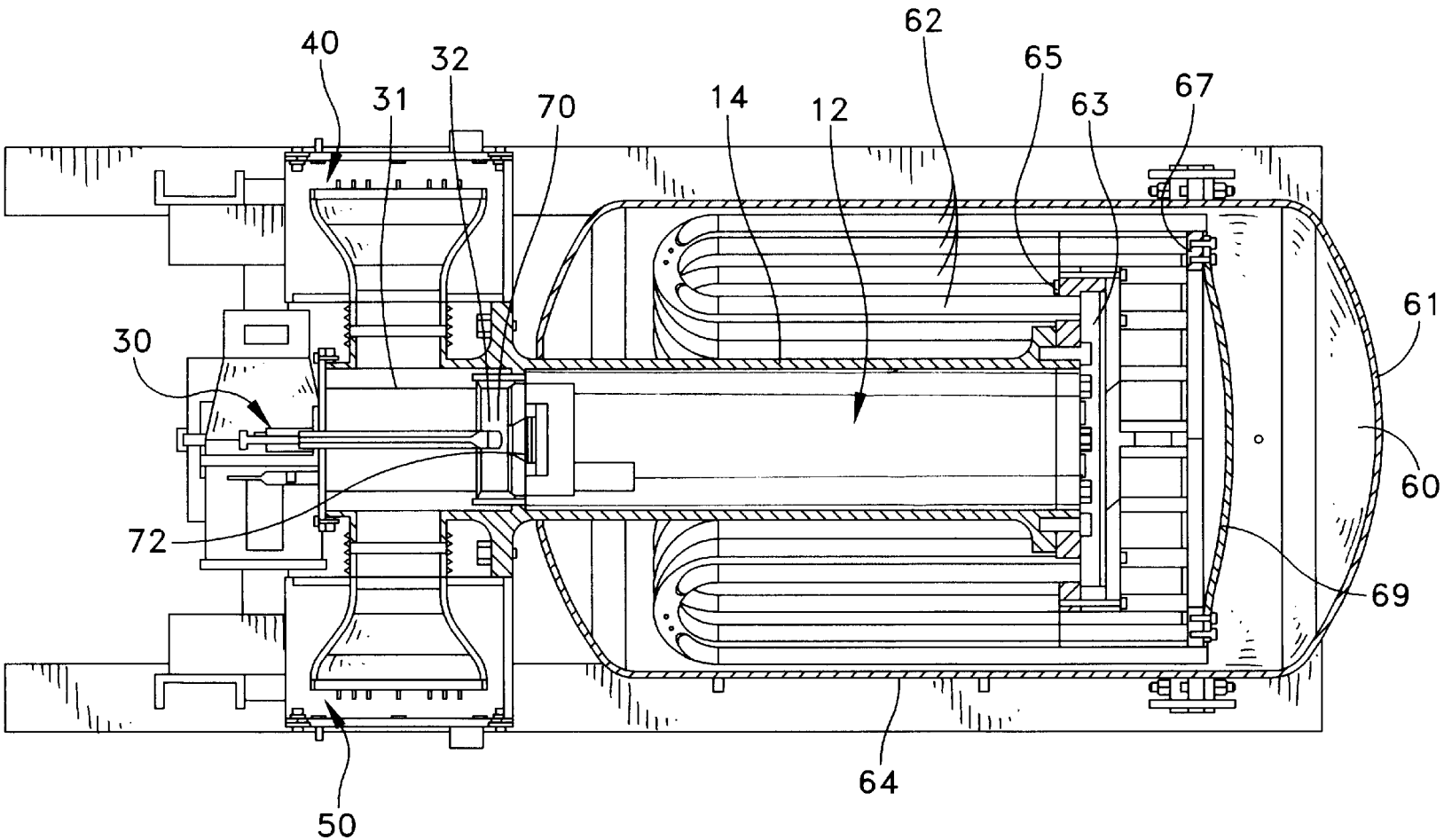
FIG. 1*b* is a sectional view in plan, taken along line 1*b*—1*b* in FIG. 1.

A pulse combustor according to the invention as illustrated in FIGS. 1*a* and 1*b* preferably includes, in succession along a flow path of the combustion and exhaust gases (generally from left to right in the figures): an oscillatory air inlet regulating section leading combustion air into a thermally conductive conduit and over and around an atomizing fuel inlet; certain restrictions or obstructions downstream of the fuel inlet and upstream of a mixing chamber, to assist in combining and mixing atomized fuel and inlet combustion air; a further restriction or flame tube plate disposed at the downstream side of the mixing chamber; an ignitor for initiating operation; and a heat exchanger in thermal contact with the conduit, in particular the portions of the conduit defining the combustion chamber and the exhaust pipes.

In a preferred embodiment, the pulse combustor can be used as a water heater or boiler. The conduit(s) at least at the combustion chamber and along adjacent portions of the exhaust path are substantially enclosed in, or otherwise placed in thermal communication with water in a tank, thus forming a water jacket around the heated portions of the combustor. Heat generated through combustion is transferred insofar as possible to the water in the tank. The ultimate exhaust gas discharged along an exhaust path exiting the combustor is relatively cool compared to the combustion temperature, however combustion is relatively complete. The water tank of the pulse combustor can be coupled into various systems in which heat energy is usefully employed, such as a circulating water system in which the water heated at the combustor is circulated through one or more heat exchangers (not shown) at which heat energy is extracted and the water is routed back to the combustor. The further heat exchangers that transfer heat energy to an application can be associated with a building heating system, an industrial process or the like. The coolant can be water circulated wholly or partly in liquid form or as steam. Other coolant liquids and gases are also applicable.

Figure 1C:
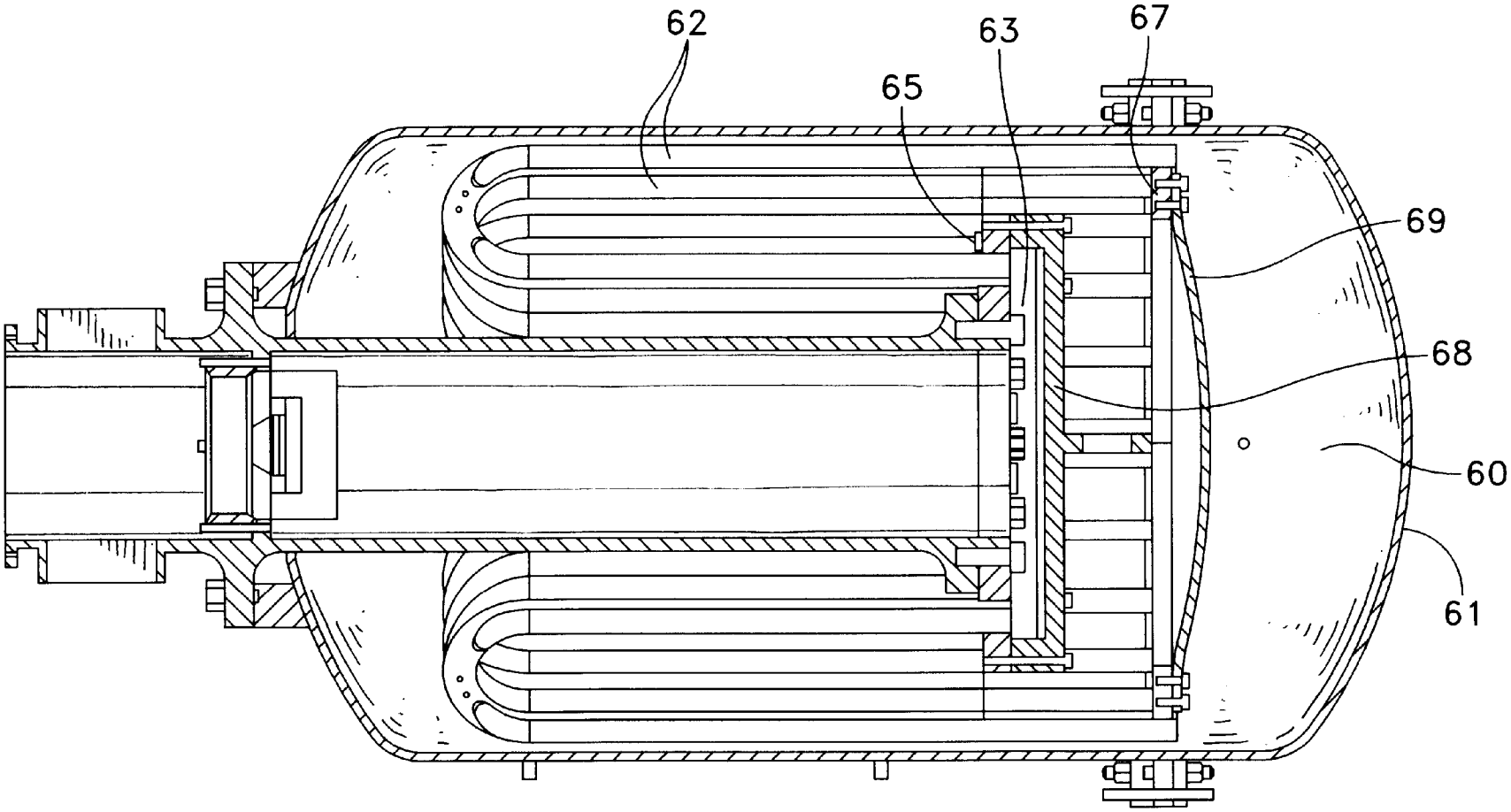
FIG. 1*c* is a partial section view illustrating construction details of the combustion chamber and water jacket.

FIGS. 1*a* and 1*b* show a preferred embodiment of the pulse-combustion boiler according to the invention. The flow of fuel and air in the boiler proceeds from left to right in FIGS. 1*a*–1*c*, into and through a combustion chamber 12 at which the air/fuel mixture is burned. The combustion chamber 12 in the embodiment shown is defined by a generally cylindrical flame tube 14, which extends substantially along the axial center of the cylindrical part or the boiler housing shown.

The inlet portion of the flame tube and the path downstream of the flame tube where the exhaust is directed have restrictions that add turbulence and flow resistances to generate some back pressure at the combustion chamber. A partially obstructed opening 72 is provided at an inlet orifice assembly 70, upstream of and leading into the combustion chamber along the gas flow path. The inlet orifice assembly defines an upstream end of a mixing chamber 20 and a flame tube plate 16 forms another restricted opening 17 at the downstream end of the mixing chamber 20. Mixing is not limited to the mixing chamber 20, nor is combustion necessarily limited to the portion of flame tube 14 that is downstream of mixing chamber 20, preferably slightly downstream of the fuel nozzle 32. However the respective obstructions contribute turbulence and help to force expanding combustion exhaust gases downstream during at least part of the resonant combustion cycle. The increases and decreases in pressure applied backwards along the flow path also open and close the air check valves or flapper valves at the air inlet, as discussed in more detail below.

Fuel is injected into the combustion air path by nozzle 32, adjacent to the upstream end of combustion chamber 12. Nozzle 32 is preferably protected and kept relatively cool by a coaxial sleeve 36 surrounding nozzle 32. Sleeve 36 has one or more holes leading incoming combustion air into the annular space between nozzle 32 and sleeve 36 for cooling purposes. The air and atomized fuel are combined in proper proportion to optimize fuel combustion. The air and fuel preferably are mixed thoroughly by turbulence at mixing chamber 20, by obstructions at inlet assembly 70 and flame tube plate 16, and also by obstructions such as steel bar 18 protruding into the flow path downstream of flame tube plate 16.

In a preferred embodiment the combustion chamber 12 is substantially integrally formed as a machined one-piece casting, for example of iron. In a preferred mode of operation, air is supplied in excess of that required to achieve a stoichiometric combustion reaction. This ensures that a high proportion of the fuel is combusted, for good efficiency and so as to generate minimal by products that may accumulate and necessitate maintenance. The pulse combustor can include a controller (not shown) for varying the proportions of air and fuel (for example by control of the fuel pump), selectively or as a function of sensed operational parameters.

A means for at least starting ignition is disposed in the combustion area 12. The ignition means provides an initial spark or similar ignition source, for at least initiating combustion of the air/fuel mixture passing into and through in the combustion chamber. Alternative embodiments for an ignition means can include, for example, one or more electric arc generating devices (spark plugs), electrically heated elements (glow plugs,) pilot flames or the like.

Figure 7:
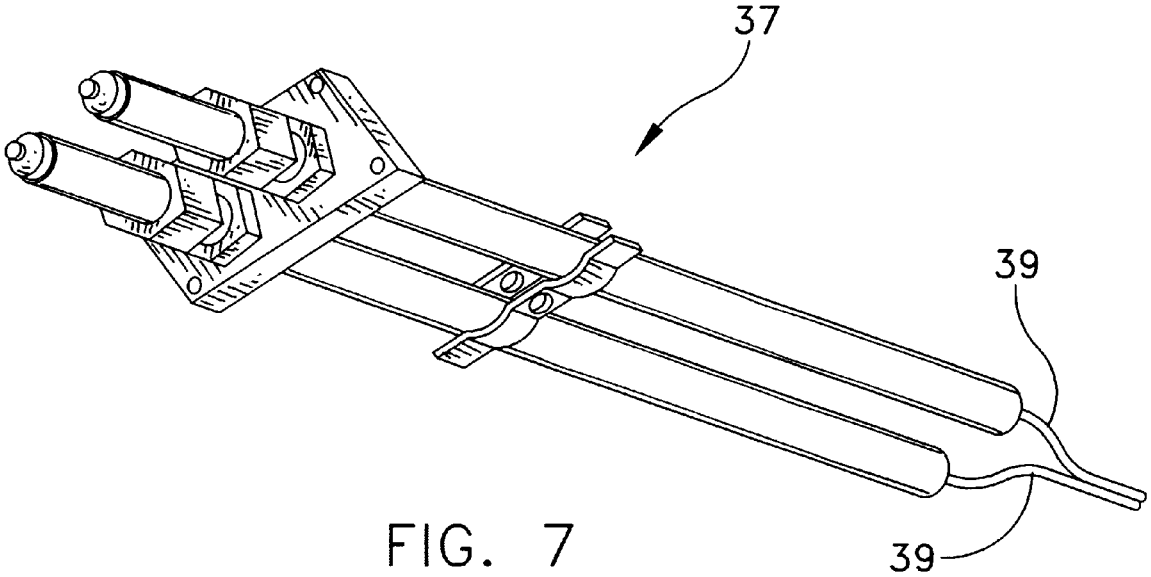
FIG. 7 is a perspective view of a diverging electrode ignitor assembly according to the invention.

In a preferred embodiment the combustible mixture is ignited by an electric arc or spark generated by producing back EMF in a voltage step-up transformer to strike an electric arc between electrodes 39, shown in detail in FIG. 7. The electrodes can define a diverging or "Jacobs Ladder" type arrangement 37, as shown. A controller stores electromagnetic energy in the transformer by coupling the primary winding of the transformer to a dc voltage component. An inductively spiked back-EMF pulse is generated on the secondary by abruptly decoupling the dc voltage, which can be done repetitively during ignition to generate successive arcs between diverging conductors extending into the path of the air/fuel mixture. The arc is initially struck between the conductors at the point where they are closely spaced, and the arc moves outwardly along the divergence.

In a startup phase, the controller operates the ignitor repetitively while supplying the inlet with forced air by switching on power to a blower that forces air along the flow path. After ignition commences, resonance drives the flow, including expansion of combusting gases followed by a drop in pressure as the expanded exhaust is drafted out, thereby drawing additional air and entrained fuel into the combustion chamber. When the ignition spark is detected at the ignitor, for example by a UV cell coupled to the controller, a fuel pump is enabled by the controller to initiate fuel flow. Ignition commences. When a flame is detected in the combustion chamber by a temperature sensor, UV scanner or other similar sensor, and preferably is maintained for a minimum time interval sufficient to ensure that the combustion chamber and the combusting air/fuel mixture therein has been heated to a temperature that will sustain combustion, the controller may disable the inlet blower and discontinue generating the ignition spark.

As air flows and fuel is pumped into the combustion chamber, pulsed combustion ensues and reaches a steady state. The flow is driven resonantly in a cycle of alternate expansion of the burning combustion gases, and convective draw of hot gases through the exhaust conduits, the latter also drawing combustion air through the flapper valve air inlet to continue the process.

The fuel nozzle assembly 30, comprising nozzle 32 and sleeve 36, supplies fuel adjacent to the upstream end of the combustion chamber 12, and preferably at the inlet to a mixing chamber 20. The illustrated embodiment operates using atomized fuel oil, which can be discharged using known nozzle types. Other types of fuel such as natural gas are also possible. The nozzle assembly is disposed substantially in an air plenum chamber 31 upstream of mixing chamber 20, and discharges in the direction of flow, preferably in a diverging pattern of atomized fuel droplets.

During operation, fuel is continuously supplied to fuel nozzle assembly 30 at a constant rate via a fuel line coupled to a pump (not shown). Such operation can be continuous or controlled by a demand thermostat arrangement in a known manner. In a preferred embodiment, the fuel pump is operable at least at two distinct flow rates, i.e., a higher flow rate and a lower flow rate, selected by the controller and/or by user switch inputs. The flow rate also may be sensor controlled, for example on startup the controller can operate the pump at a lower input rate for initial spark ignition, and then can switch over automatically to the higher input rate after a main flame is detected and conditions indicate that combustion has become self-sustaining. Additionally the user may be provided with means to alter the fuel flow rate to adjust or switch the level at which the combustor generates heat.

With reference to FIGS. 1*b,* 1*c* and 3, an inlet orifice assembly 70 leading into mixing chamber 20, divides the plenum chamber 31 from the combustion area 12. The inlet orifice assembly includes an inlet opening 72 which is smaller in flow cross section than the internal dimension of the combustion chamber downstream of the orifice assembly 70. This provides a flow restriction. Restrictions along the flow path have at least two distinct functions due to the back-and-forth motion of the gas that is caused by the oscillating pulsed flow. Restriction(s) along the flow path provide back pressure during the combustion or positive pressure phase of each cycle of pulsed combustion, namely a pressure component directed opposite the flow path due to expansion of the combusting air/fuel mixture. The restrictions along the flow path thus form a backstop structure against which the force of expanding combustion gases can act to force the exhaust gases forward along the flow path. In the reduced pressure phase of the resonant cycle, convective draw due to expanded exhaust gas disposed in the conduits downstream of the combustion chamber, draws inlet air forward along the flow path.

The flow restriction(s) increase the linear speed of the fuel/air mixture in the area of the cross sectional restriction, compared to flow at the same rate through a larger cross section, and also induce turbulence in the form of eddies on the downstream side of the restriction. Both the speed increase and the turbulence contribute to fuel/air mixing and thus to combustion efficiency.

In the preferred embodiment shown, the inlet opening 72 provides a reduction in diameter or restriction of the cross sectional area of the flow path. Downstream of the restriction the gases are turbulent, including a generally toroidal eddy current motion. In addition, downstream of the inlet opening 72 is a diverter 73 having a series of circumferential vanes 74 which induce a second turbulence effect to facilitate mixing of the fuel and combustion air. In the preferred embodiment, the diverter comprises a frustoconical member 76 connected to a supporting ring 77 by a series of radially elongated vanes 74. Each vane comprises a sheet metal blade that is tilted relative to a plane normal to the axis, in a circumferential direction, to divert the flow in a circumferential direction as it moves axially forward, i.e., to impart a helical flow. The toroidal eddy currents and the helical diversion add together two or more distinct forms of turbulence to provide a complex meandering flowpath for droplets of fuel and surrounding combustion air, and a good mixing effect. The diverter opening 75 likewise is preferably smaller than inlet opening 72 to augment the turbulence-inducing effect of the orifice assembly 70 by forming a restriction in cross sectional area, further improving mixing of fuel and combustion air.

Each flapper valve assembly 50 is enclosed in an inlet air decoupler assembly 40 which communicates with the plenum chamber 31 of the fuel nozzle assembly 30. The inlet decoupler serves as a receiver and distributor for the combustion air, as well as an expansion space that muffles sound waves emanating from the resonant combustion process taking place further on, particularly in combustion chamber 12.

Figure 2B:
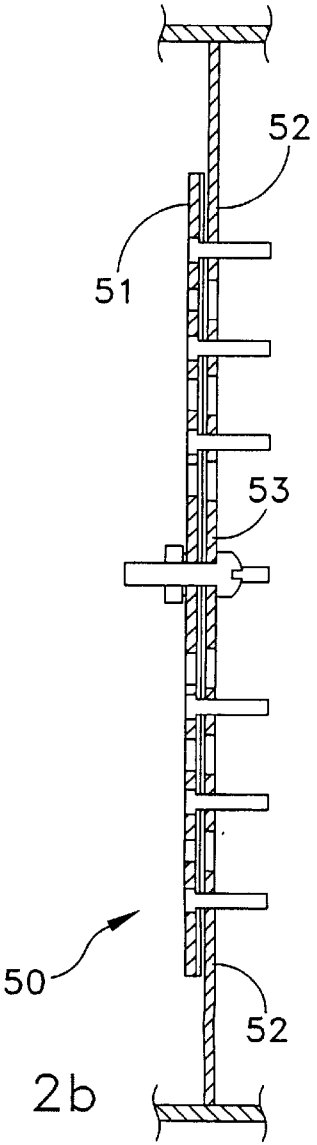
FIG. 2*b* is a section view of the air flapper valve of FIG. 2*a*.
Figure 2A:
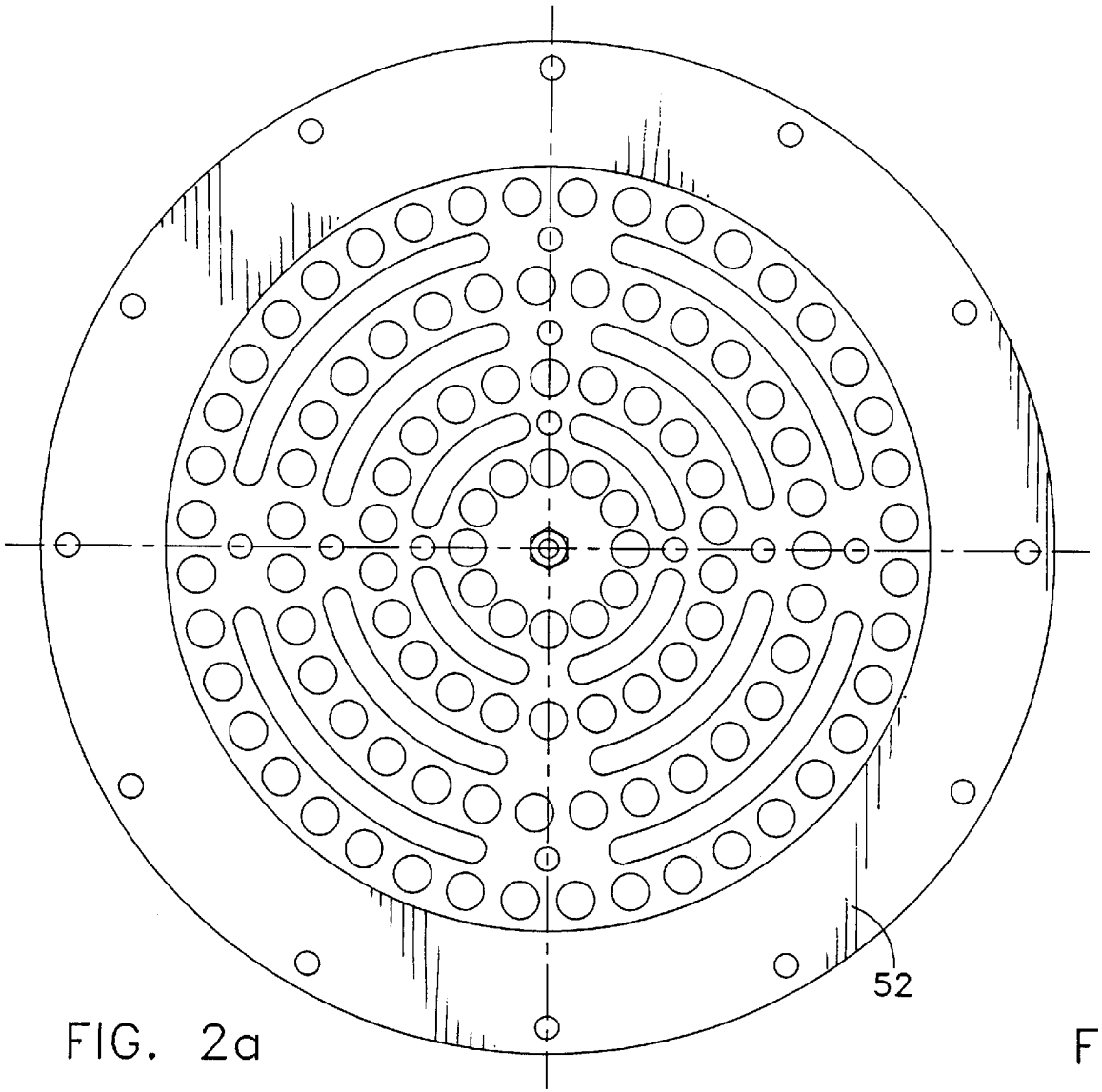
FIG. 2*a* is an elevation view of an air flapper valve assembly according to the invention.
Figure 4:
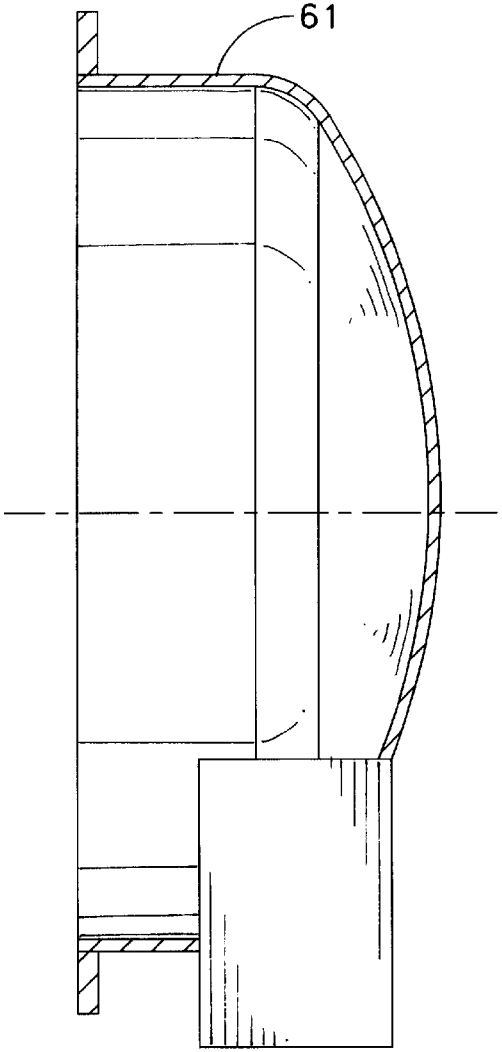
FIG. 4 is a longitudinal section view showing the end bell exhaust decoupler of the invention.
Figure 3:
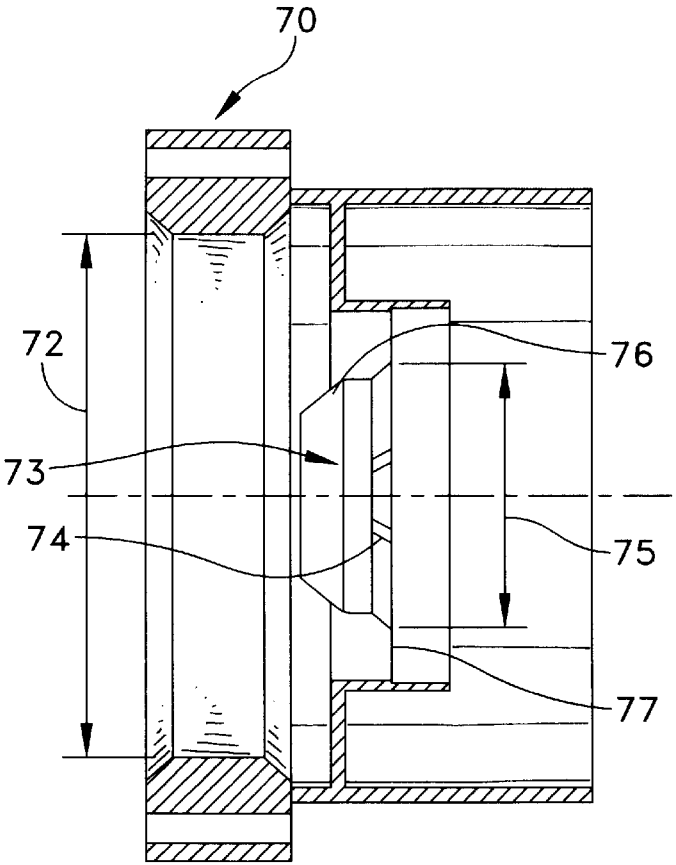
FIG. 3 is a longitudinal section view showing the turbulence inducing structure located downstream of the fuel nozzle along the flow path of the combustion air.

As shown in FIGS. 2*a* and 2*b,* each flapper valve assembly 50 comprises two circular plates, namely a backer plate 51 and an orifice plate 52. The backer plates and orifice plates of the respective valves are each aligned along a common central axis and fixed in a predetermined spaced relationship by a spacer 53. A plurality of guide pins 54 are fixed between plates 51, 52. Preferably, the orifice plate 52 has a number of circular apertures and the backer plate 51 has a number of circular and slot apertures. A flapper wafer 55 having alignment holes corresponding to guide pins 54, is movably disposed between orifice plate 52 and backer plate 51. The flapper wafer 55 oscillates between the plates 51, 52, along the path of guide pins 54 through each combustion cycle. The flapper wafer 55 includes a plurality of slots that are aligned with the slot apertures of backer plate 51 and misaligned with the circular apertures of orifice plate 52. Thus, in one position the flapper wafer 55 blocks backward flow and in the other position forward flow is permitted, the valves being arranged to pass air from the inlet decoupler 40 and to block air from returning, in the manner of check valves that oscillate open and closed at the resonant pulsed combustion frequency. The flapper wafer is formed from a flexible, heat and wear resistant material. Preferably, the flapper wafer comprises a Teflon coated fiberglass wafer. Each flapper valve assembly 50 is mounted in an air conduit, which communicates with the air plenum 31.

Referring again to FIGS. 1*b* and 1*c,* downstream of the combustion chamber 12, hot combustion gases flow through an array of exhaust tubes 62, coupled to a circular chamber 63 disposed axially adjacent to the combustion chamber 12. In the embodiment shown, a first annular distribution plate 65 has a relatively smaller diameter than a second annular distribution plate 67. These distribution plates form axially spaced annular rings at different radii, with the space between them traversed by tubes 62, which loop axially back and radially outwardly to occupy a substantial part of the volume of the water jacket. The first distribution plate 65 directs the exhaust gases from the combustion chamber 12 into the exhaust tubes 62. The exhaust tubes in the embodiment shown extend longitudinally back, parallel to, and at a radial space from the combustion chamber 12. The exhaust tubes then curve radially outwardly and then forward, again parallel to the combustion chamber, to the second annular distribution plate 67. Second distribution plate 67 is axially spaced from and radially outside the first annular distribution plate 65.

Figure 5A:
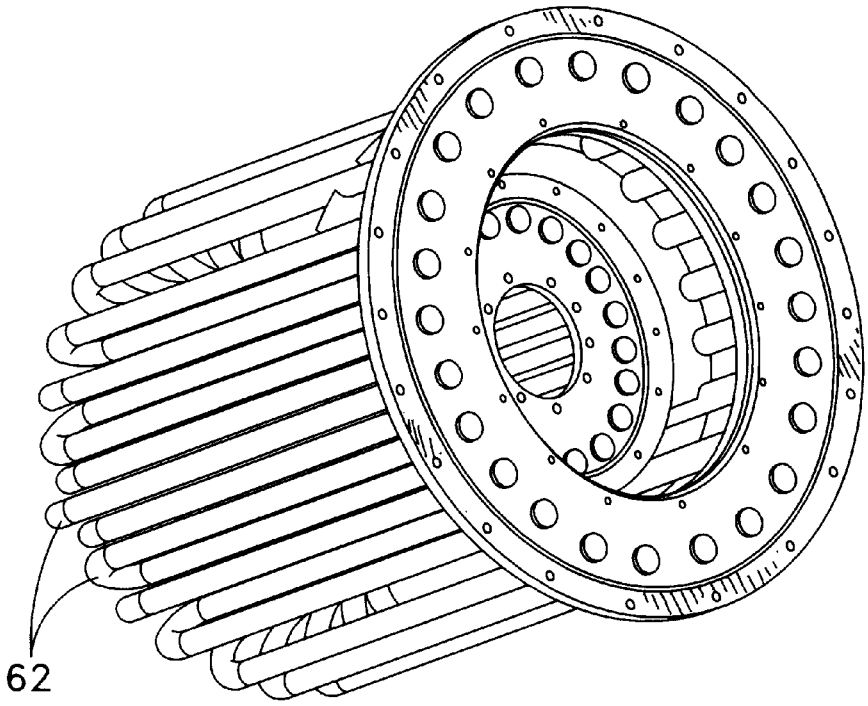
FIG. 5*a* is a perspective illustration of the heat exchanger tube array.
Figure 5B:
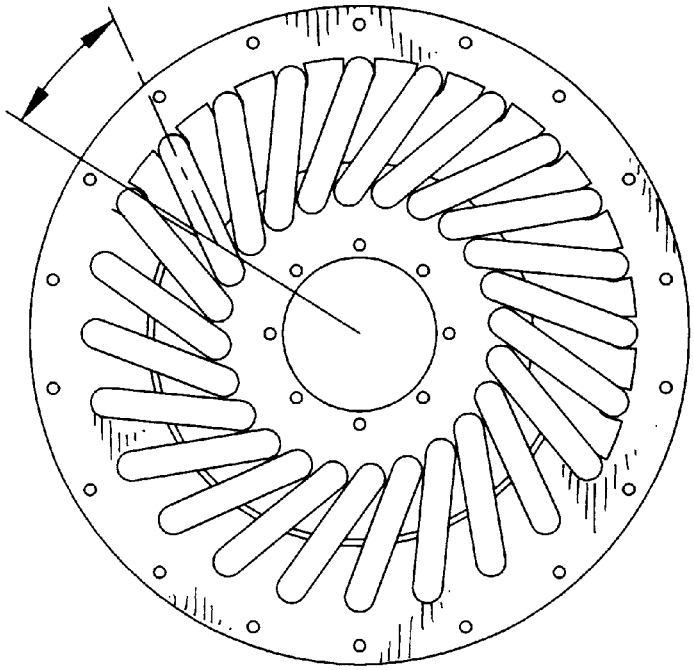
FIG. 5*b* is an end view of the tube array of FIG. 5*a*.

The exhaust tubes can be oriented such that respective back and forward extending portions of each tube are radially aligned. However preferably the exhaust tubes are radially skewed, as best shown in FIGS. 5*a* and 5*b*. More particularly, the point at which each U-shaped exhaust tube connects to the first or inner distribution plate 65 is angularly displaced from the point at which that tube connects to the second or outer distribution plate 67. In the embodiment shown the skew is equal to the angular distance between one tube and the next. This skew is such that the respective back and forward axially extending tube portions are angularly offset from a radial extension line, and the curving ends of the tubes are compactly stacked or angularly overlapped as shown in FIG. 5*b*. This arrangement increases the length and surface area of the tubes as compared to an arrangement in which the tubes are radial rather than skewed, to provide for an efficient and compact design.

The exhaust tubes 62 and combustion chamber 12 are enclosed in an outer wall structure defining a water jacket 64 in which the combustion chamber and exhaust tubes 62 are completely immersed. The first annular distribution plate 65, the first partition plate 68 (shown in FIG. 1*c*), and the circular chamber 63 bounded thereby, are likewise fully immersed in the water jacket 64. Immersion of these relatively-hotter upstream elements provides good transfer of thermal energy from the combustion gases to the circulating water.

According to another inventive aspect, the second annular distribution plate 67 and the second partition plate 69 are not fully immersed. Instead these relatively cooler downstream elements are disposed at the outside boundary of the water jacket. That is, bell housing 61 bounds a portion of the exhaust flow path together with second annular plate 67 and second partition plate 69, such that the exhaust decoupler 60 is disposed at the outside boundary of the unit rather than being immersed within and bounded on all sides by the water jacket (compare inner structures 63, 65). The volume inside bell housing 61 contains exhaust air and thus is pressurized at most only slightly above the ambient atmospheric pressure that is incident on the opposite side of bell housing 61. In this manner, bell housing 61, which is the boundary element having the greatest span, need not withstand a substantial pressure difference.

The water enclosed in the water jacket preferably is pressurized in the typical application of the invention to a boiler. Thus the inner distribution plate 65 and inner partition plate 68 must withstand a pressure differential between the water or vessel pressure and the pressure within the exhaust decoupler, only slightly above atmospheric pressure. Thus there is a substantial pressure difference across plates 65, 68. These plates are accordingly made of a thick and durable material and are securely bolted or otherwise mounted, as needed to confine the pressure vessel. In contrast, the pressure difference across the bell housing is minimal, so the bell housing can be constructed of relatively light material such as thin sheet metal and need not be as securely mounted. In short, according to the invention the exhaust decoupler is not located at a position immersed on all sides within the water jacket, as might be considered appropriate for maximum thermal transfer between the exhaust gases and the water in the water jacket. Instead, the exhaust decoupler is in contact with the water jacket but is located outside of the water jacket, bounding the outer periphery of the combustor unit. As a result, the bell end or bell housing is made a relatively lighter or thinner material than the inner elements that confine the water jacket and need to be made of a heavy pressure-resistant material. However, these inner elements span a shorter distance than the bell housing because they are internal of the bell housing. At a given pressure in a pressure vessel, an increase in linear dimensions or span of a vessel defining wall may require a geometrically corresponding increase in thickness. However according to the invention the pressure vessel defining elements are internal and therefore smaller than the outer elements. The invention allows the overall combustor unit to be constructed from lighter materials, at considerably reduced expense, without compromising the structural integrity of the boiler, and with minimal effect on thermal transfer efficiency.

The exhaust decoupler 60 is positioned on the bell end of boiler, downstream of the combustion chamber 12, and communicates with the combustion chamber via the array of exhaust pipes 62. The exhaust decoupler 60 serves as a receiving chamber for exhaust gases and as an expansion space to muffle sound waves emanating from the pulsed combustion in combustion chamber 12. In the preferred embodiment as shown, twenty-four 1.25" outer-diameter exhaust pipes couple the combustion chamber 12 to the exhaust decoupler 60.

The water jacket 64 has inlet and outlet ports (not shown) for circulating water through the tank under power of a pump or similar element in an external circulating water system adapted to make use of the heat energy. Heat generated by combustion is transferred to the circulating water by contact between the hot gases, the thermally conductive structures separating the combustion chamber from the water jacket, and the water or other coolant contained in the water jacket. The rate of thermal transfer can be enhanced by increasing the surface area of contact, for example by providing heat transfer fins (not shown) to increase the surface area of contact. Normally, such fins are only employed on the gas side of the heat exchange path because contact between the denser water and the surface more effectively conducts thermal energy than contact on the gas side.

Figure 6:
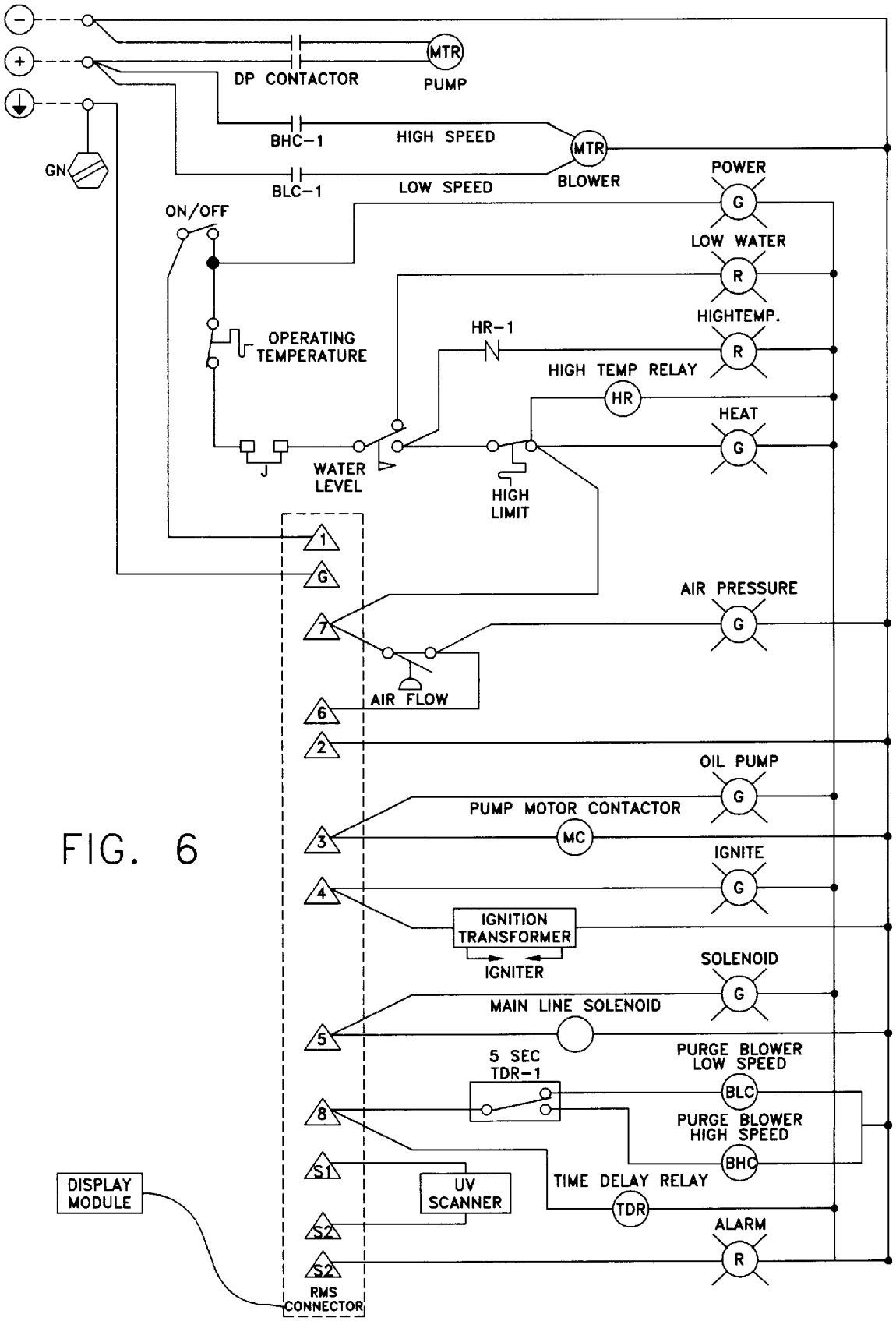
FIG. 6 is a relay ladder diagram illustration operation of the combustor of the invention.

The sequence of operation of the apparatus can be appreciated with further reference to FIG. 6, which shows a schematic relay ladder diagram with associated relays, actuators, sensor and switches. When the power on/off switch is closed, and there is sufficient water to close a level responsive switch, and the temperature is between an operating temperature and a high limit temperature, a call for heat is enabled. The pulse combustion process begins by activating a starter blower to initially pressurize the system, and preferably by first operating at a low speed blower level for a pre-purge period, for example, five seconds, after power-on and heat-enabled, as provided in the operating control. Initially, combustion air is fed under blower power; the ignitor is operated periodically for a starting interval through an ignition transformer; and if the UV scanner detects a spark or flame, fuel is provided. At 15 seconds from the start of this function, the blower is switched to high speed by time delay relay TDR-1. Combustion proceeds and after a time may become self-sustaining with the convection and expansion of hot exhaust gases being sufficient to draw combustion air and to expel the exhaust. After a timed interval, the starter blower may be deactivated.

Sinusoidal pressure waves are generated by pulsed combustion fed by oscillatory air from the flapper valves in a resonant manner. The pulsed pressure waves provide the necessary force to draw combustion air and to drive exhaust flow. Air flow input through the decoupler forces the flapper wafer 55 of each flapper assembly 50 against its backer plate 51, allowing air to pass through each flapper assembly and into the air plenum 31. Pressure during the combustion part of the cycle closes the flapper assemblies in the manner of check valves. The pressure against the closed flappers contributes to moving the exhaust gases forward toward the exhaust. The flow is also driven in part by convective drawing of the exhaust, and in part by back pressure from expansion of combusting gases against obstructions along the flow path during a part of the resonant combustion cycle.

Atomized fuel is introduced through the fuel nozzle assembly 30, through the inlet orifice assembly 70, and into the combustion chamber 20. The fuel combines with sufficient air at least to form a combustible air/fuel mixture, and preferably to form a combustible mixture with excess oxygen for clean burning. Mixing is facilitated by turbulence due to obstructions, preferably successive forms of turbulence involving eddy currents oriented in different directions. The air/fuel mixture is ignited initially by the spark generated from the transformer, the spark being struck between diverging electrodes in a "Jacob's Ladder" type electrode arrangement. After a startup interval combusting fuel and residual heat in the combustion chamber ignite the incoming air/fuel mixture without the need for an additional source of ignition. Sensors and controls are provided to enable fuel flow upon detection of a spark, to change the rate of fuel flow and may disable the combustion air blower upon detection of a main flame, and generally to enable or disable operation of the entire unit depending on temperature, flow and coolant levels remaining at safe levels. Combustion continues with the main flame and the heated surfaces in the chamber sustaining combustion so long as fuel and air continue to be supplied.

The ratio of combustion air to fuel is determined in part by the structure of the flapper valve. By increasing the axial space occupied by spacer 53, a higher ratio of air to fuel is obtained. Preferably the combustor is operated with a combustion air feed rate greater than a stoichiometric rate needed precisely to react with all the available oxygen with all the available hydrocarbons (i.e., air is oversupplied to the combustion reaction), whereby the combustor is clean burning.

Oxidation of the fuel oil and propagation of the flame continue along the flow path and into the combustion chamber 12. One or more restrictions or flow directing vanes or the like proved turbulence. Combustion gases exiting the combustion chamber are distributed through the twenty-four exhaust pipes, which are immersed in the volume of water in tank 64.

Upon exiting the exhaust pipes, the combustion gases are further expanded and decoupled in the manifold referred to as the exhaust decoupler 60. The combustion chamber 12 and the exhaust pipes 62 are each substantially enclosed within the cylindrical water tank 64, thus facilitating heat transfer from the hot combustion gases to the water at the point where the temperature difference between the combustion gases and the water is high and the air/fuel mixture flow is relatively turbulent and high in speed, for efficient thermal transfer. From the exhaust decoupler 60, which is disposed in part at the relatively cooler outer perimeter of the unit, outside the volume enclosed by the water jacket, the flue gases are vented. Preferably the flue gases pass to the outdoors through a chimney (not shown).

During the low pressure or drawing phase of the combustion cycle, oxygen bearing gas passes through the apertures of the flappers, the orifice plate 52 and backer plate 51. During the high pressure phase of the combustion cycle, expanding gases force flapper wafer 55 away from the backer plate 51 and against the orifice plate 52. This blocks the apertures in the orifice plate 52, creating back pressure which forces the combustion exhaust to advance through exhaust pipes 62. As the cycle continues, back pressure drops off with convective flow of the exhaust, and a partial vacuum arises. Wafer 55 then is lifted from orifice plate 52 and bears against backer plate 51, again permitting inlet combustion air to be drawn in. These phases are resonantly cycled at a relatively low frequency, for example about 65–75 Hz, the precise frequency being determined by the respective dimensions of the combustor and by various physical parameters.

The flapper valve assemblies 50 regulate the feed of combustion air, and the travel of the flapper wafer, determined in part by the size of the spacer, is a factor in the flow rate. The flow rate can be adjusted by providing for a choice of spacers of different sizes, such that the boiler can be operated at higher or lower levels of excess air, as required.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A pulse combustor comprising;

a combustion chamber having an inlet end defining an inlet opening into the combustion chamber with an inlet orifice assembly including a diverter having a plurality of circumferentially disposed vanes connecting a frustoconical member to a support ring, the vanes being angled to induce a helical flow component to combustion air flowing from the inlet end into a mixing area of the combustion chamber, toward an outlet of the combustion chamber;

an exhaust decoupler chamber;

a plurality of exhaust tubes communicating between the outlet of said combustion chamber and said exhaust decoupler chamber;

a fuel nozzle assembly for introducing fuel into said mixing chamber and said combustion chamber, said fuel nozzle assembly having a discharge end with a fuel nozzle orifice proximate said inlet orifice assembly;

an air intake assembly for introducing combustion air into said mixing chamber and said combustion chamber, said air intake assembly comprising an air decoupler chamber having an air flapper valve assembly operatively engaged therein operating as a check valve;

an ignition device for initiating pulsating combustion within said mixing chamber and said combustion chamber with operation of the air flapper valve; and, a water jacket for circulating water outside said mixing chamber, said combustion chamber, and said exhaust pipes, whereby heat generated by pulsating combustion is transferred to the circulating water.

2. The pulse combustor of claim 1, wherein the exhaust decoupler is positioned on an outer perimeter bell end of the combustor.

3. The pulse combustor of claim 1, wherein the exhaust tubes are substantially coextensive with and extend parallel to the combustion chamber.

4. A pulse combustor comprising;

a combustion chamber having an inlet end defining an inlet orifice assembly with an inlet opening for receiving fuel and combustion air moving along a flow path through the combustion chamber wherein the inlet opening is smaller than the internal dimension of the combustion chamber and wherein said inlet orifice assembly comprises a diverter to induce turbulence in the fuel and combustion air;

an exhaust decoupler chamber downstream of the combustion chamber along the flow path, the exhaust decoupler chamber discharging spent exhaust gases;

a plurality of thermally conductive exhaust tubes communicating between said combustion chamber and said exhaust decoupler chamber;

a fuel nozzle assembly coupleable to a fuel source for introducing fuel into said combustion chamber, said fuel nozzle assembly having a discharge end with a fuel nozzle orifice proximate said inlet orifice assembly;

an air intake assembly for introducing combustion air into said combustion chamber, said air intake assembly comprising an air decoupler chamber having at least one air flapper valve assembly operatively engaged therein operating as a check valve, and wherein the air intake assembly, the combustion chamber, the exhaust tubes and the exhaust decoupler are structured to support pulsating combustion wherein pressure of combusting fuel and convective drafting alternately close and open the flapper valve assembly, respectively;

an ignition device for at least initiating combustion in said combustion chamber with operation of the air flapper valve; and, a water jacket for circulating water outside said combustion chamber, and at least a portion of said exhaust pipes, whereby heat generated by pulsating combustion is transferred to the circulating water.

5. The pulse combustor of claim 4 wherein said diverter includes a plurality of vanes.

6. A pulse combustor comprising;

a combustion chamber having an inlet end defining an inlet orifice assembly with an inlet opening for receiving fuel and combustion air moving along a flow path through the combustion chamber wherein the inlet opening is smaller than the internal dimension of the combustion chamber and wherein said inlet orifice assembly comprises a diverter having a plurality of vanes to induce turbulence in the fuel and combustion air;

an exhaust decoupler chamber downstream of the combustion chamber along the flow path, the exhaust decoupler chamber discharging spent exhaust gases;

a plurality of thermally conductive exhaust tubes communicating between said combustion chamber and said exhaust decoupler chamber;

a fuel nozzle assembly coupleable to a fuel source for introducing fuel into said combustion chamber, said fuel nozzle assembly having a discharge end with a fuel nozzle orifice proximate said inlet orifice assembly;

an air intake assembly for introducing combustion air into said combustion chamber, said air intake assembly comprising an air decoupler chamber having at least one air flapper valve assembly operatively engaged therein operating as a check valve, and wherein the air intake assembly, the combustion chamber, the exhaust tubes and the exhaust decoupler are structured to support pulsating combustion wherein pressure of combusting fuel and convective drafting alternately close and open the flapper valve assembly, respectively;

an ignition device for at least initiating combustion in said combustion chamber with operation of the air flapper valve; and, a water jacket for circulating water outside said combustion chamber, and at least a portion of said exhaust pipes, whereby heat generated by pulsating combustion is transferred to the circulating water.

7. The pulse combustor of claim 1, wherein the vanes are circumferentially disposed in the diverter.

8. The pulse combustor of claim 7, wherein the vanes are angularly disposed to induce a helical flow component to the fuel and combustion air.

9. The pulse combustor of claim 8, wherein the vanes connect a frustoconical member to a support ring.

10. The pulse combustor of claim 1, wherein the exhaust decoupler chamber is positioned on an outer perimeter of the combustor outside of the water jacket.

11. The pulse combustor of claim 1, wherein the exhaust tubes are substantially coextensive with and extend parallel to the combustion chamber.

12. The pulse combustor of claim 11, wherein the exhaust tubes communicate with the combustion chamber via a cylindrical chamber.

13. The pulse combustor of claim 12, wherein the cylindrical chamber is axially located between the combustion chamber and the exhaust decoupler.

14. The pulse combustor of claim 1, wherein the air intake assembly comprises a pair of housings coupled to the combustion chamber, each housing having an air flapper valve assembly operatively engaged therein.

15. The pulse combustor of claim 14, wherein the pair of housings are contained in an air decoupler chamber.

16. The pulse combustor of claim 1, wherein the ignition assembly comprises a transformer which generates a spark between diverging electrodes.

17. The pulse combustor of claim 1 further comprising a fuel pump assembly for supplying a continuous supply of fuel to the fuel nozzle assembly at a predetermined pressure and rate.

* * * * *